US010973715B2

(12) United States Patent
Baer

(10) Patent No.: US 10,973,715 B2
(45) Date of Patent: Apr. 13, 2021

(54) POWERED PEDESTRIAN APPARATUS

(71) Applicant: William Baer, Simi Valley, CA (US)

(72) Inventor: William Baer, Simi Valley, CA (US)

( * ) Notice: Subject to any disclaimer, the term of this patent is extended or adjusted under 35 U.S.C. 154(b) by 226 days.

(21) Appl. No.: 15/987,582

(22) Filed: May 23, 2018

(65) Prior Publication Data

US 2018/0338876 A1 Nov. 29, 2018

Related U.S. Application Data

(60) Provisional application No. 62/509,781, filed on May 23, 2017.

(51) Int. Cl.

| | |
|---|---|
| ***A61G 5/04*** | (2013.01) |
| ***A61G 5/10*** | (2006.01) |
| *A61G 5/06* | (2006.01) |

(52) U.S. Cl.

CPC ..... *A61G 5/04* (2013.01); *A61G 5/042* (2013.01); *A61G 5/1056* (2013.01); *A61G 5/1059* (2013.01); *A61G 5/06* (2013.01); *A61G 5/1078* (2016.11); *A61G 5/1081* (2016.11)

(58) Field of Classification Search

CPC .... A61G 5/042; A61G 5/1059; A61G 5/1056; A61G 5/04; A61G 5/06; A61G 5/1081; A61G 5/1078; A61G 5/14; A61G 5/1089; A61G 5/1094; A61G 7/1048; A61G 7/1059; A61G 2200/36; A61G 2203/12; A61G 2203/14; A61G 2203/723; B62D 51/02

See application file for complete search history.

(56) References Cited

U.S. PATENT DOCUMENTS

| | | | | | |
|---|---|---|---|---|---|
| 3,189,345 | A * | 6/1965 | Simpson | A61G 7/1046 | 482/67 |
| 3,629,880 | A * | 12/1971 | van Rhyn | A61G 7/1096 | 5/83.1 |
| 3,872,945 | A * | 3/1975 | Hickman | A61H 3/04 | 180/65.6 |
| 4,155,416 | A * | 5/1979 | Ausmus | A61G 5/045 | 180/214 |
| 4,443,902 | A * | 4/1984 | Baer | A61G 7/1017 | 280/304.1 |
| 4,768,536 | A * | 9/1988 | Hawkins | A61H 3/04 | 135/67 |
| 4,802,542 | A * | 2/1989 | Houston | A61G 5/1051 | 180/65.51 |
| 4,809,804 | A * | 3/1989 | Houston | A61G 5/1051 | 180/65.51 |
| 4,985,947 | A * | 1/1991 | Ethridge | A61G 7/1017 | 280/250.1 |
| 5,168,947 | A * | 12/1992 | Rodenborn | B60L 53/14 | 180/19.1 |
| 5,265,689 | A * | 11/1993 | Kauffmann | A61G 5/042 | 180/65.51 |

(Continued)

*Primary Examiner* — Steve Clemmons

(74) *Attorney, Agent, or Firm* — Paul D. Chancellor; Ocean Law

(57) ABSTRACT

A powered pedestrian apparatus is provided having two vertical panels, two rotatably connected articulating arms capable of rotating about a center point, a vertical lifting device located within said panels attached to said arms, and a foot platform wherein one or more of an electric motor, front tires and caster wheels enable movement of the powered pedestrian apparatus.

20 Claims, 10 Drawing Sheets

(56) References Cited

U.S. PATENT DOCUMENTS 5,320,122 A * 6/1994 Jacobson, II ..... A61H 3/04 135/66
5,411,044 A * 5/1995 Andolfi ..... A61G 7/1017 135/66
D369,578 S * 5/1996 Andolfi ..... D12/128
5,937,959 A * 8/1999 Fujii ..... A61G 5/047 180/12
6,053,519 A * 4/2000 Poindexter ..... A61G 5/042 180/907
6,446,742 B1 * 9/2002 Wilson ..... A61G 5/1091 180/65.6
7,086,491 B2 * 8/2006 Matte ..... A61G 5/042 180/65.1
7,364,184 B2 * 4/2008 Delhotal ..... A61G 5/00 280/47.4
7,392,554 B1 * 7/2008 Su ..... A61G 7/1017 5/86.1
7,717,200 B2 * 5/2010 Kakinuma ..... A63C 17/08 180/218
8,141,669 B1 * 3/2012 Laymaster ..... B60K 7/0007 180/65.6
8,172,023 B1 * 5/2012 Irvine ..... A61H 3/008 180/208
8,955,871 B2 * 2/2015 Takamoto ..... A61G 5/14 280/657
9,016,715 B2 * 4/2015 Moliner ..... A61G 5/042 180/907
9,050,225 B2 * 6/2015 Ooka ..... B62J 1/28
9,289,339 B2 * 3/2016 Gray ..... A61G 5/124
9,301,894 B2 * 4/2016 Mulhern ..... A61G 5/042
9,393,698 B1 * 7/2016 Vo ..... A61G 5/04
9,433,552 B2 * 9/2016 Chang ..... A61H 3/04
9,477,228 B2 * 10/2016 Field ..... B60N 2/045
10,045,895 B2 * 8/2018 Eklof ..... A61G 7/1051
10,525,784 B2 * 1/2020 Goffer ..... A61G 5/042
2006/0191726 A1 * 8/2006 Matte ..... A61G 5/042 180/65.1
2014/0338119 A1 * 11/2014 Henshaw ..... A61G 7/1007 4/667
2015/0231005 A1 * 8/2015 Gray ..... A61G 5/14 5/86.1
2018/0056985 A1 * 3/2018 Coulter ..... A61G 5/061
2019/0247696 A1 * 8/2019 Park ..... A61H 1/0244
2020/0179194 A1 * 6/2020 Mulhern ..... A61G 5/125

* cited by examiner

POWERED PEDESTRIAN APPARATUS

CROSS REFERENCE TO PENDING APPLICATIONS

This application claims benefit of prior filed provisional application No. 62/509,781 entitled "Powered Universal Walker" filed on May 23, 2017 in the name of William Baer of Simi Valley, Calif., said provisional application being hereby incorporated by reference as if fully set forth herein.

FIELD OF THE INVENTION

This invention relates to the field of apparatus which are designed to aid operators in movement and carrying and retrieval of items for those who require mechanical aids to aid in walking or riding, where the rider is supported in either a seated or standing position. The apparatus is designed for the long term or temporary handicapped person having difficulty walking or working, including those with long term arthritis or neuropathy condition where they present problems limiting their ability to work and stand any periods of time. It is also designed for large warehouse operations where employees need to travel long distances between stations or racking to pick and pull items. The invention can also be used in the office environment as a tool for those to carry materials around in the office due to tight turning radius and ability to carry items independent of the operator.

SUMMARY OF THE PRIOR ART AND STATE OF THE ART

This invention is applied to all fields as disclosed and the current state of the art does not incorporate all of the claimed and disclosed attributes in one apparatus nor does the prior art suggest that combining various attributes known currently as the state of the art into one machine or apparatus. Especially to note, that this apparatus as disclosed herein aids not only in the transportation of those unable to move but also accommodates those unable to move from sitting or laying positions. The prior art is replete with transportation modes but concentrates in wheel-chair like apparatus for those bound to those devices rather than those that might have an ability or limited ability to transit themselves. The bounds of this invention though expand to those who require a quick mode of travelling distances in office and warehouse modes where materials are gathered and often retrieved at long distances from deposit points. The ability for one apparatus to be able to move materials long distances, such as a repairman or troubleshooting technician, that is required to respond over long distances with their equipment. Warehouses often have bicycles or pullman tugs but their limited maneuverability once items are carried are an issue and they do not have any kind of work surface to work upon. And no prior art encompasses all of these attributes for those with ambulatory attributes with attributes accompanying those who have limited or no ambulatory abilities in one apparatus. It is also an attribute of this invention, not found in the prior art, that independent suspension and drive capabilities are incorporated along with large diameter wheels to smooth the ride and distribute the weight of the user and apparatus.

BRIEF SUMMARY OF THE INVENTION

The invention disclosed in this patent combines the attributes needed for those with no or limited ambulatory capabilities with those attributes needed to assist those who have ambulatory skills but must travel distances while carrying materials and equipment or when retrieving materials from a distance. This invention serves the same class of people with different attributes for each. It creates a working class of people who currently cannot not operate in office or warehouse environments as they are of limited ambulatory abilities. It also creates a single device that aids those who need assistance getting up from chairs or beds, using a device that is designed for off balance applications of weight. This apparatus is a battery powered apparatus which allows for the rider to sit or stand while transiting and provides a turning radius no greater than the wheelbase of the machine. Articulating front wheels and bumper structure allows for transiting on steep slopes and restraint bars allow for rider safety. A working surface is incorporated that can be used to carry materials, tools or equipment for the user. Extending the undercarriage is used to laterally influence the center of gravity of this machine to allow for a user to move from a bed or sitting position without fear of rolling the apparatus over on them. Power assisted lifting arms serve many purposes including speed and direction controls and aiding the user in achieving a vertical attitude.

Modular componentry is used to aid in the assembly of this device with minimal internal components that will also facilitate the ease of maintaining and repairing this device. Power Walker is designed for low cost production with parts of high impact strength with extensive safety features included in the design. The invention incorporates a very small foot print that allows for almost perfect circle movement in small areas. The ability to adjust the foot print of base allows movement in bathrooms where patient can be lowered into toilet position by themselves. Retraction of the base casters powered or mechanically makes this possible. Extension of the base caster wheels allow user to back up to chair or bed to lift a person upright from chair sitting or bed sitting position into a full standing position. Extending the rear wheels also gives a person more stability in faster movement.

Stiffening members with conical interfaces sandwich the molded exterior panels creating a lateral stiffness to the apparatus while allowing for a torsional moment which allows for the apparatus to transverse over uneven ground. The stiffening members are designed in parallel to allow this torsional movement over uneven ground without loosening the panels that they hold.

There is a front bumper which is used for two main purposes; one is to prevent damage when impacting surfaces and secondly is constructed to allow for allow movement up higher surfaces without impinging the larger front tires and causing the apparatus to bottom out in the valley prior to the higher surface. The front wheels also allow for downward sloped irregular surfaces such as handicap ramps where the front wheels prevent the apparatus from leaning too far forward, possibly ejecting and injuring the rider. Tilting the bumper, which is integral with the front wheels, allows the machine to be raised so it can be pushed manually. The front wheels, when extended, are also used to free wheel the unit around when motor is not under power and movement is needed. The front bumper is used for impacting objects on purpose such as pushing boxes or other items out of the drivers way.

The front wheels are of large diameter to create a smooth ride and are driven by independent direct current motors interfaced through a wormgear drive to the drive wheels. Steering is accomplished through independently controlling the motors. Speed is regulated through static devices and electronically through potentiometers. Reversing the device is done with momentary contact buttons to prevent accidental reversing of the apparatus and swiveling caster wheels on the back of the apparatus allows for a turning about the circumference of the machine center with a radius no greater than the wheelbase. Hone can maneuver into a situation, they should be able to turn themselves around.

Invention features include a powered lifting aid for a seated person to be elevated slow and safely into a standing position using body straps or lift belt to aid the person to be removed from a sitting or prone position into the apparatus. A lift bar is inserted for hand grip which can be used along with the side lift rails this during lifting from seated position. Once elevated, the patient can readjust the safety belt for added comfort. Safety belting protects against fainting other conditions such as loss of balance.

Most walkers are not powered and standup wheel chairs have high center of gravity as well as concentrate on lifting position. These machines are very costly and do not have all the advantages in one cost effective strong machine. This apparatus is relatively lightweight and the center of gravity is very low based on the battery weight and hollow plastic construction above the center of gravity. Most of the prior art does not have saddle style seats nor does the prior art allow for both stand-up and seating positions in a single device.

It is an object of this invention to create an apparatus that has advantages to those who are dependent on walkers or wheelchairs for mobility as well as used by ambulatory people who need to travel long distances in offices and warehouses and provide a working platform for them.

It is an object of this invention to create an apparatus which has a movable center of gravity which thereby allows for a user to extricate themselves from a chair or bed without the fear of having the apparatus fall into them. Furthermore, the apparatus should aid the person by raising the apparatus along with the person so that they can more easily enter the apparatus.

It is an object of this invention to create an apparatus that is easy to assemble and manufacture thereby reducing costs and price to the ultimate end user.

It is an object of this invention to allow for use by the operator in either a standing or seating position and is easily able to use either position with minimal interference or additional operations. It is another object of this invention is to keep the standing position as low as possible to the floor in a more natural location, so psychologically the operator is in a more natural standing position very close to the floor surface. This is also prevent accidental falls or trips entering or egressing from the apparatus.

It is an object of this invention to create an apparatus that is torsionally stiff but allows for vertical adaptations to the surfaces that the apparatus is traveling on. Furthermore, this apparatus must be able to maneuver through valleys and slopes without getting hung up or straddling due to the horizontal distance between the wheels.

It is an object of this invention to create this apparatus with independent drive trains, thereby decreasing turning radius and increasing maneuverability.

DETAILED DESCRIPTION OF THE INVENTION

Figures 1, 2:
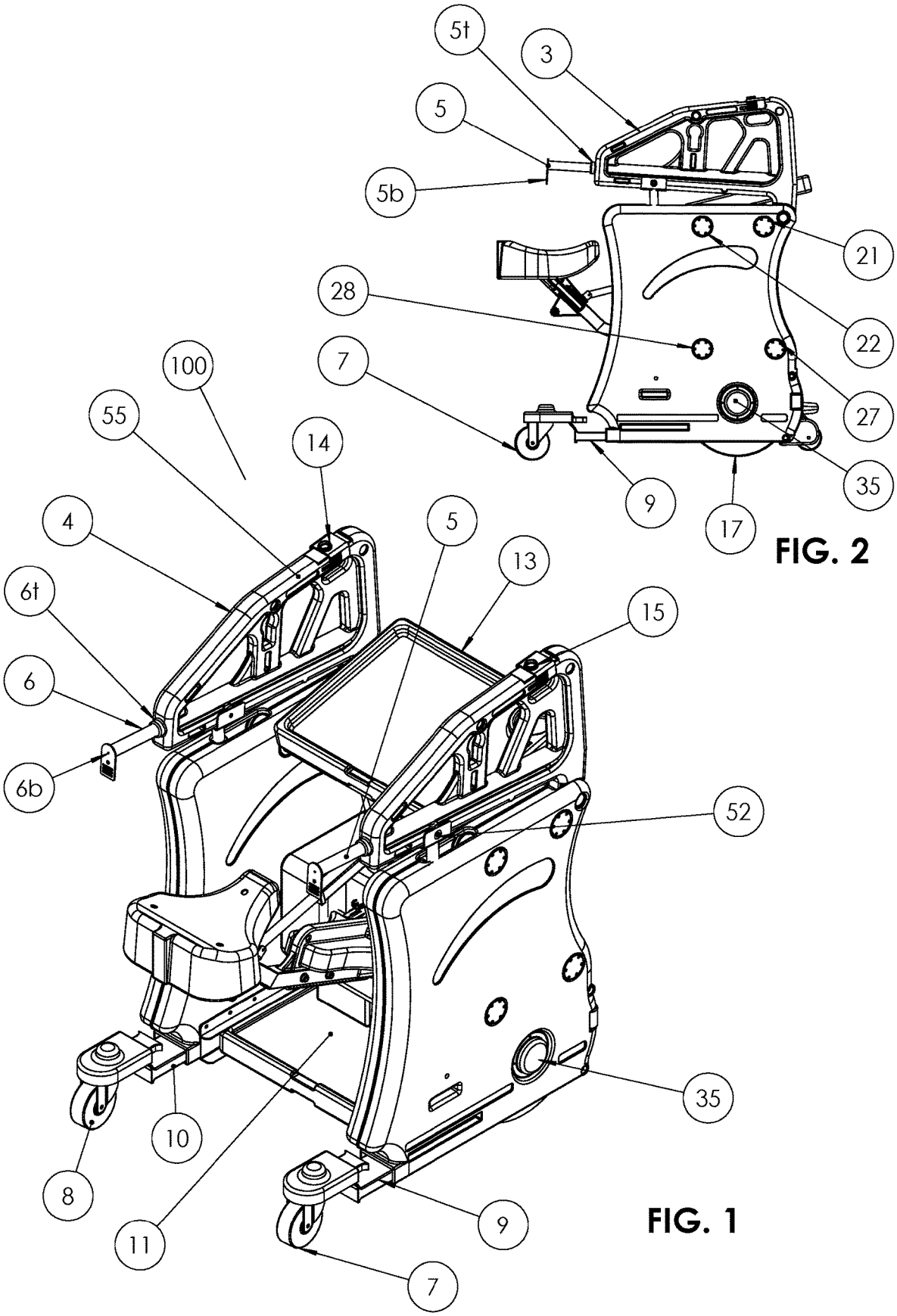
In FIG. 1, the apparatus is shown in a rearward oblique view where the rear wheels have been extended and the arm supports have also been extended.
In FIG. 2, a right side view of the apparatus is shown with the rear wheels extended and the arm supports extended.
Figure 4:
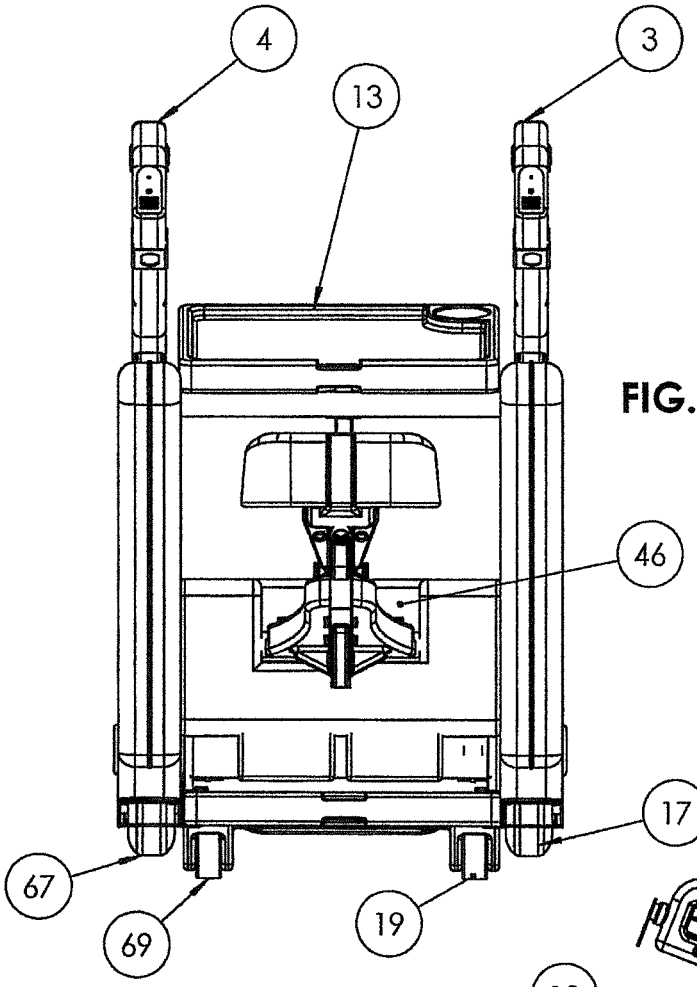
In FIG. 4, a rearward view of the apparatus is shown.

This invention as disclosed in the drawings has the principle use for transporting people, whether they are unable to walk due to temporary or permanent injury, medical issues, such as paralysis, arthritis or neuropathy.

Figure 18:
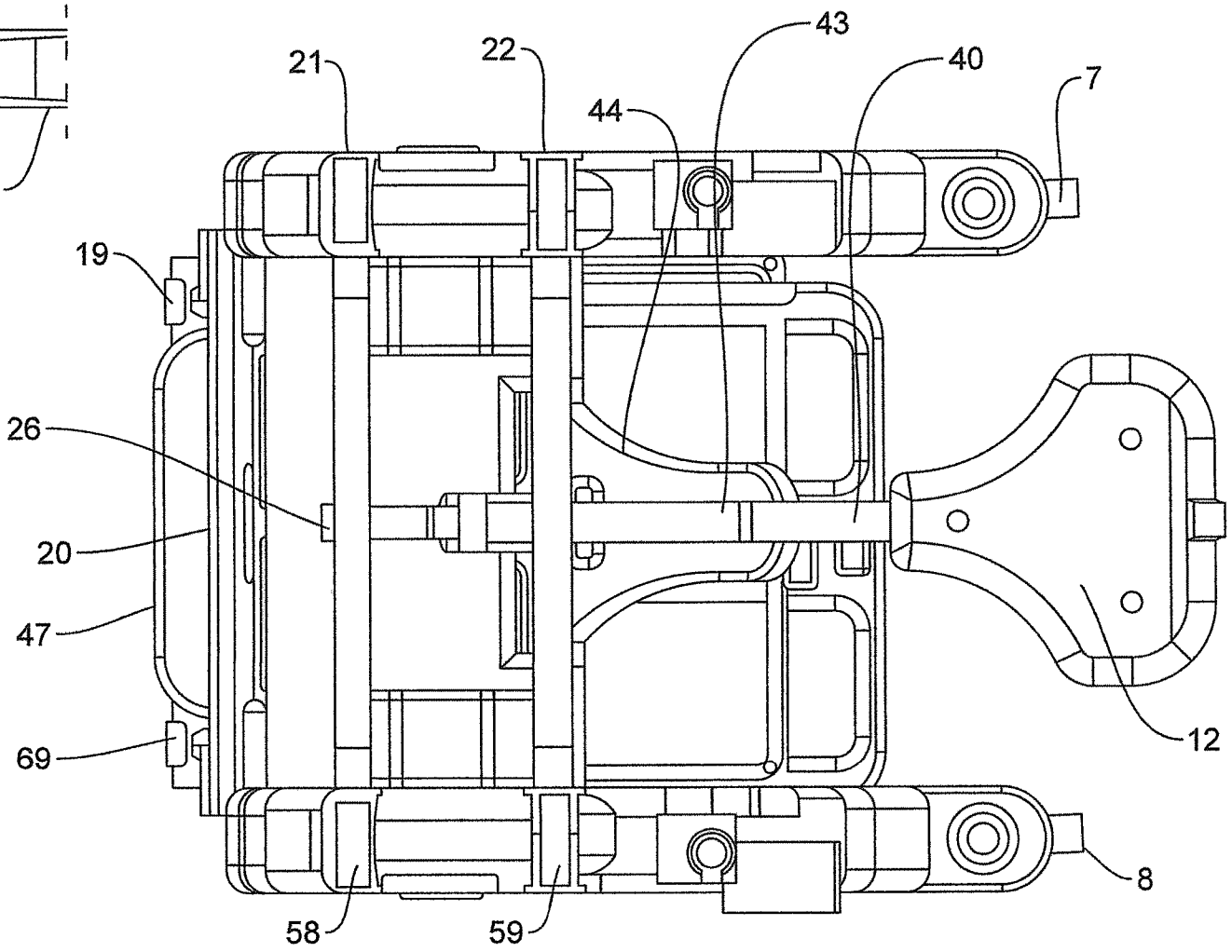
In FIG. 18, is a horizontal cut-away which details the two upper stiffening members as they are inserted through the left and right exterior panels.
Figure 19:
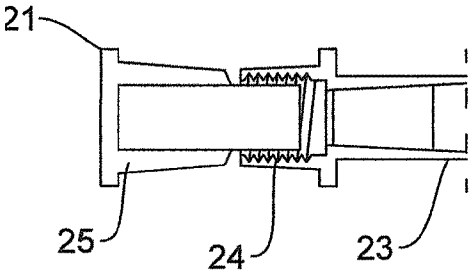
In FIG. 19, the conical male and female sections of the stiffening member attachment means are cross-sectioned.

The apparatus 100 is shown in FIG. 1, where the apparatus is defined by two vertical panels 1,2 on the right and left side of the apparatus respectively, with the upper stiffening members 21 and 22 holding panels in place. FIG. 18 details their location in the apparatus. Stiffening members are constructed in a manner where a cylindrical hollow tube 23 whose cross-section and wall thickness are sufficient to prevent torsional movement between said panels. In this case, the cross-sections are circular but there are no limiting factors to prevent square or hexagonal tubing to be use or any other hollow member that will accomplish the similar task of restricting torsional movement between the panels. It is noted in FIG. 19 that a female conically related adaptor 24 is used at the open ends of tube 23, inserted thereinto and held in place by crimping, swaging or any other appropriate method. Male conically related adaptor 25 is threadably related to the female adaptor 24. The conical surfaces are used to mate with holes in the left and right panels, such that the members are held in the horizontal plane, parallel to the horizontal plane of the apparatus. The two conical sections sandwich the inner and outer portions of panels 1 and 2. Furthermore, member 21 has attached thereto the seat rotational pivot point 26 for the raising and lowering of the seat assembly 12. The user has the ability to move the seat into a forward position. Additionally, panel 3 is held through lower supports 27 and 28 using the same conically related adaptors whereby stiffening rods 64 and 45 are connected through the battery compartment structure 30 to lower supports 58 and 59 respectively on panel 4 through stiffening rod 64 and seat rotational rod 45 respectively. This further stiffens the apparatus torsionally.

Figure 9:
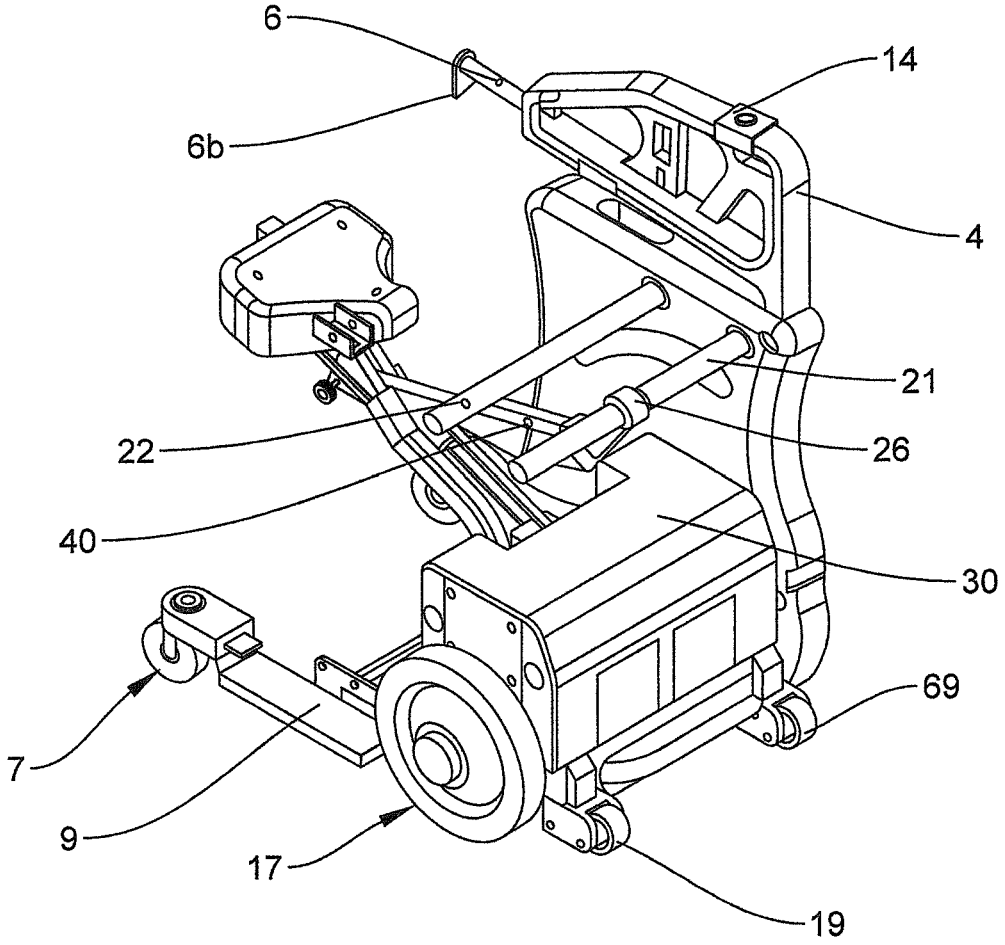
In FIG. 9, a right side frontal oblique view is shown where the right side exterior panel has been removed for clarity to detail the battery and drive assembly compartment.
Figure 10:
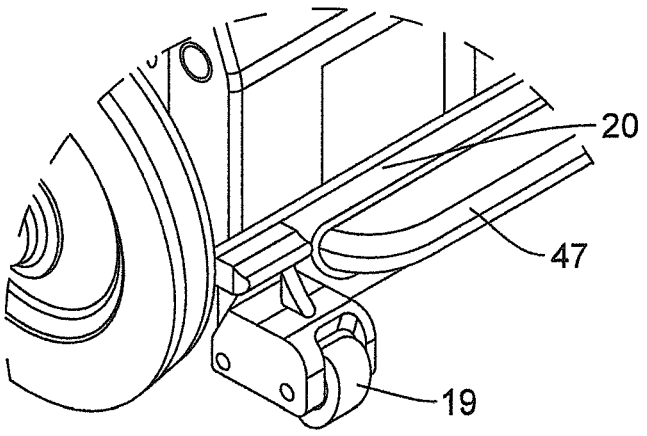
In FIG. 10, a detail view of the front wheels in the retracted or running position is shown.

FIG. 2 shows the location of the lower stiffening members, whose construction and connection adaptors are similar to those shown with stiffening members 21 and 22. FIG. 1 and FIG. 2 details the location of a working surface or desk 13 which is positioned between the interior portions of panels 1 and 2 and upwardly related to the stiffening members 21 and 22, said desk 13 being rotatably attached to stiffening member 22 thereby allowing the user to define the slope of the desk 13. Rear wheels 7 and 8 extended rearwardly from the lower portion of the apparatus 100 toward the rear of the apparatus 60. Each wheel 7 and 8 is slidably attached to the lower portion of panels 1 and 2 using rails 33 and 32 respectively. FIG. 9 is a cutaway view showing the arm 9 in location.

Figure 12:
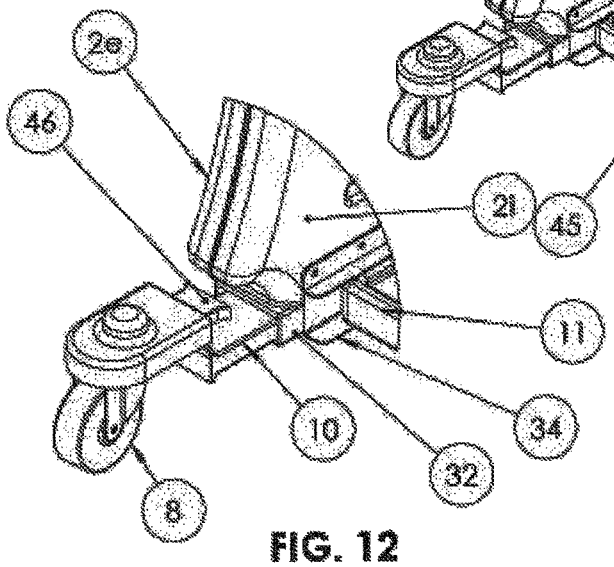
In FIG. 12, the left rear wheel is show in the extended position.
Figure 16:
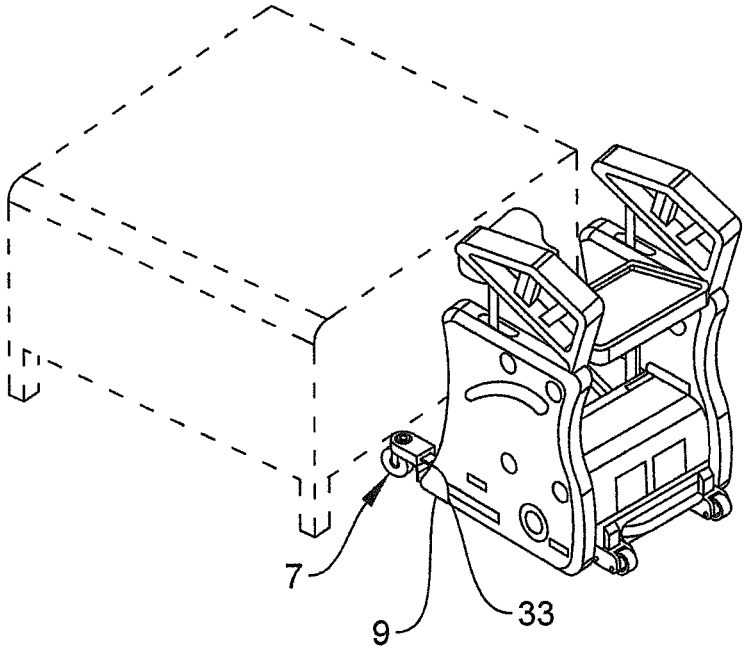
In FIGS. 16 and 17, the apparatus is shown with the rear wheels extended as the apparatus is slid under a bed and the arms have been raised.
Figure 17:
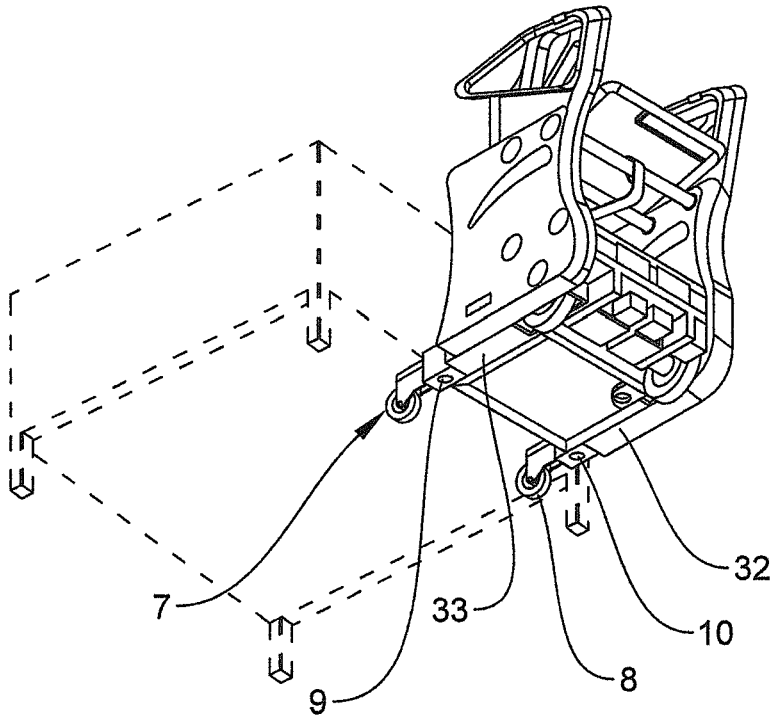

FIG. 12 details the how the extension arm 10 is internally related to rail 32. This is similar to the relation of arm 9 and rail 32 associated with the right side of the apparatus. As disclosed herein, the purpose of the extension arms is to move the center of gravity rearwardly to accommodate a person being lifted off of a chair or bed. The apparatus is designed to allow the wheels and arms to extend and be placed under the bed or chair, as shown in FIGS. 16 and 17. As detailed in FIG. 1, extending supporting extension arm rests 5 and 6 further allow the user to reach the apparatus as it is placed under a chair or bed. Said arms are slidably attached to arms 3 and 4 respectively through arm receiver 5*t* and 6*t*. Arm tabs 5*b* and 6*b* are located at the proximal end of said arm rests to allow for ease of extending and replacing said arms.

Figure 15:
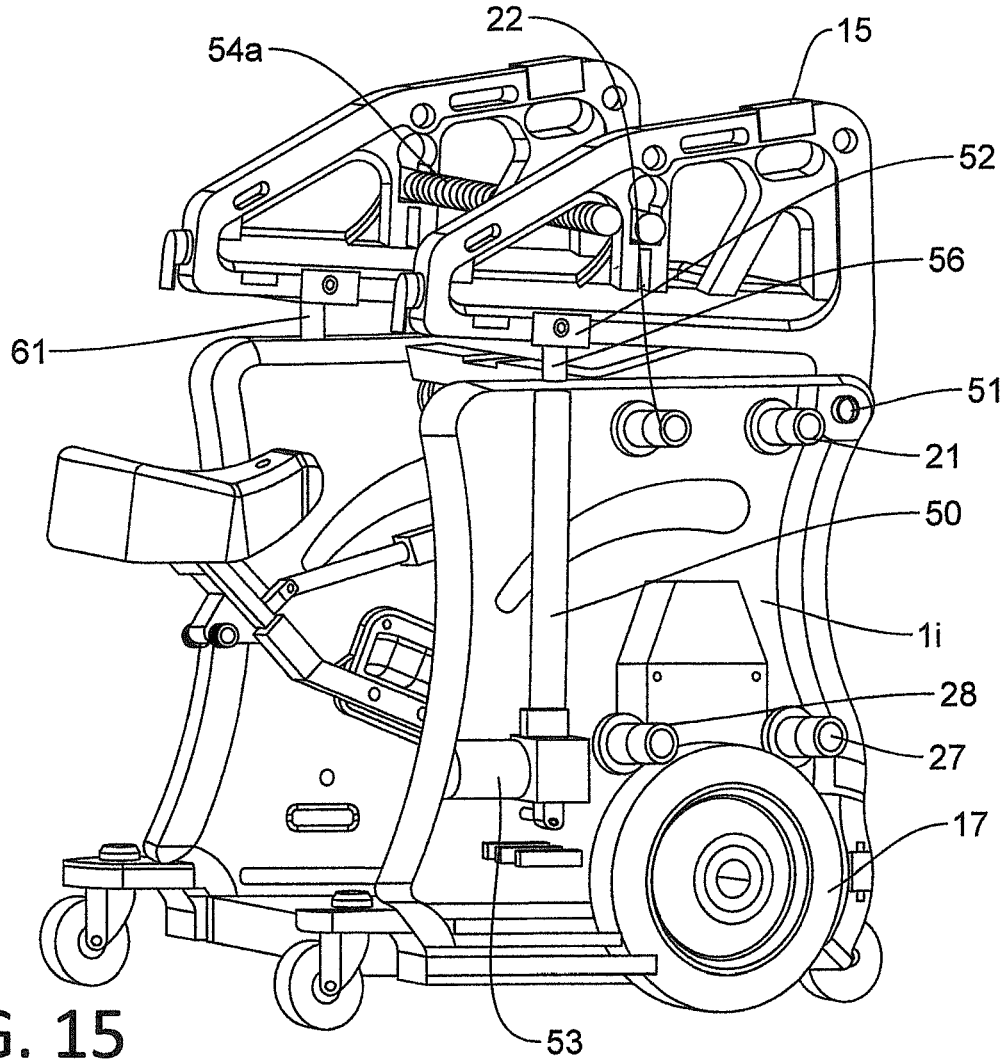
In FIG. 15, a rearward oblique view is shown where the exterior panel of the right has been cross-sectioned to show the interior of the panel and the vertical actuator for the handles is seen.

Arms 3 and 4 serve several purposes and are designed to be molded from plastic but this does not preclude the use of other materials whose strength and rigidity will not degrade the performance of the arms. The arm 3 is rotationally attached to the upper front portion of the panels 1 by right arm rotational rod 53. Arm 4 is rotationally attached to the upper front portion of the panels 1 by right arm rotational rod 54. Both rod 53 and 54 are held within the panel structure and do not interfere with the height adjustment of table 13. Arms 3 and 4 are used in combination to contain support rod 54 as seen in FIG. 15. This rod 54 is removable as it could interfere with the use of desk 13 and is mainly used by people as the apparatus assists them from a sitting or prone position. The user can grab onto the rod 54 to assist themselves in locating themselves in the apparatus. Furthermore, the arms are able to raise and lower as they rotate about their respective rotational rods. The arm 3 is raised and lowered through actuator 50 located in the interior 1*i* of panel 1. Arm 4 is raised and lowered through actuator 62. Actuator 50 is attached to arm 3 with bracket 52 which allows for the vertical movement of rod 56. Actuator 50 is driven by actuator motor 53 with sufficient drive potential that will allow for the user to be gently lifted from a sitting or prone position into the apparatus. Arm 4 is raised with actuator 62 using bracket 65 through the vertical movement of actuator rod 66. As the arms rise, the user is naturally moved into a standing position where they can use support rod member 54 to finalize their location in the apparatus. The right side panel 4 has the same actuator 61 located in the interior of the panel and is a mirror image to the right side as show in FIG. 15. An additional purpose for the arms 3 and 4 is to provide anchoring locations for safety equipment such as back supports when a user is unable to hold their vertical posture whether sitting or standing.

Figure 13:
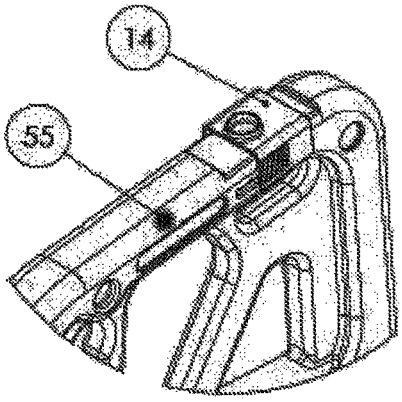
In FIG. 13, the drive button assembly is shown in detail.
Figure 11:
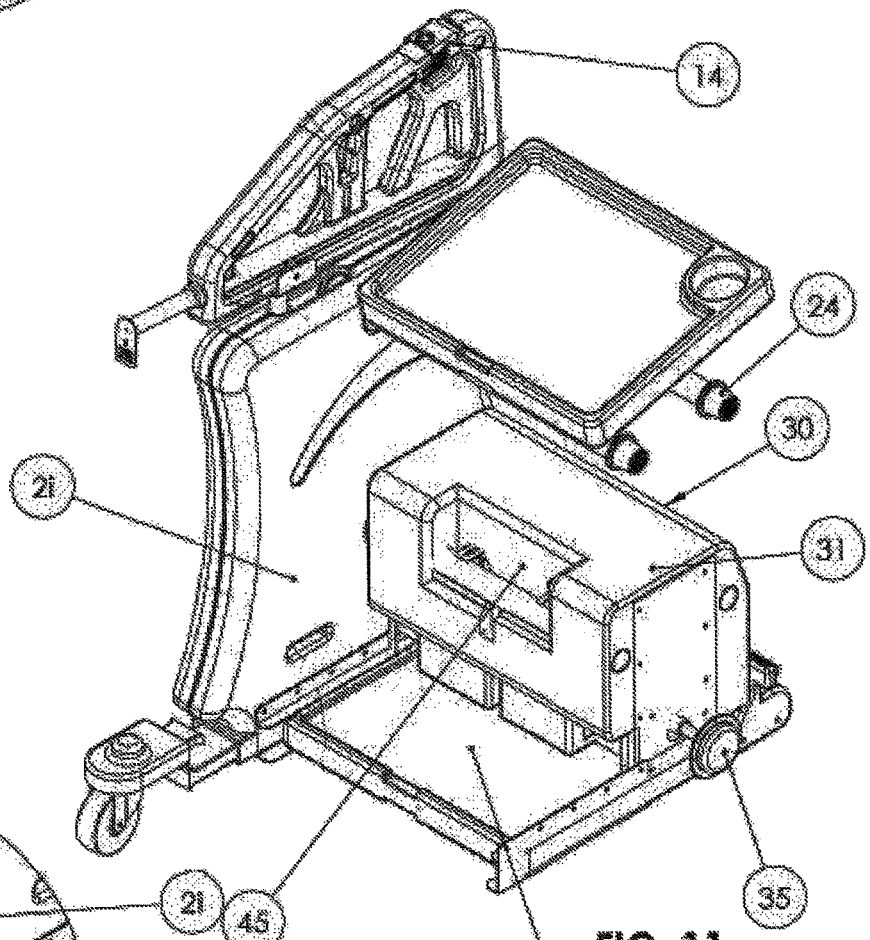
In FIG. 11, a rearward right side oblique view is shown where the right exterior panel has been removed to improve the clarity of the lower components of the apparatus.
Figure 14:
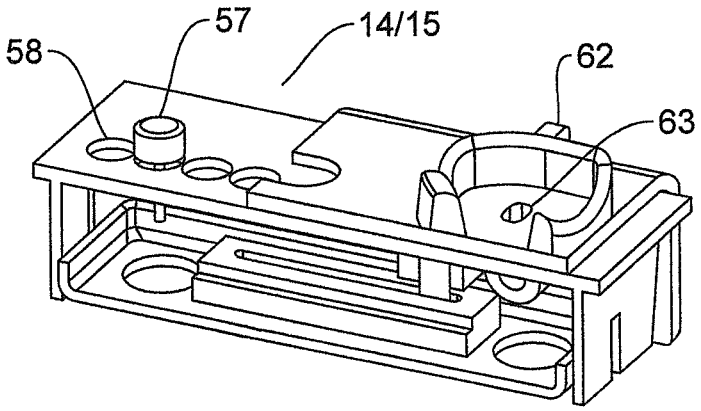
In FIG. 14, a cross-sectional view of the button is shown detailing the guide stops for limiting speed.

Located on the forward portion of arm 3 is the drive switch 14 which is detailed in FIG. 13 and FIG. 14. FIG. 13 also shows reversing contact 55. Reversing contact 55 is located within the normal hand position of the user but is only a momentary contact switch. This is a safety feature of the apparatus whereby the user will not be able to reverse the direction of the drive wheels without their intentionally pressing of the contact 55. This precludes accidental reversing when the user forgets whether the apparatus is in forward or reverse drive states. Drive switch 14 is designed for use with the operator's finger or thumb, as switch 14 has a positive thumb capture enclosure 62. It is an embodiment of this invention to have a recessed momentary contact button 63 recessed so that the users must have their thumb or finger attached to the slide enclosure so that accidental striking or jarring will not start the apparatus. Further safety is found in the speed limiting features of the switch 14. Speed limiting slot 58 or velocity restrictor that has several holes which allow for the insertion of a speed limiting pin 57. FIG. 14 further details an internal potentiometer which has built in linear resistance which prevents sudden starts by limiting the acceleration speed at which the apparatus can start. Can be modified for dual control on either side to accommodate those with only one arm or can be used with the remote control fob 90 by the user.

Figure 5:
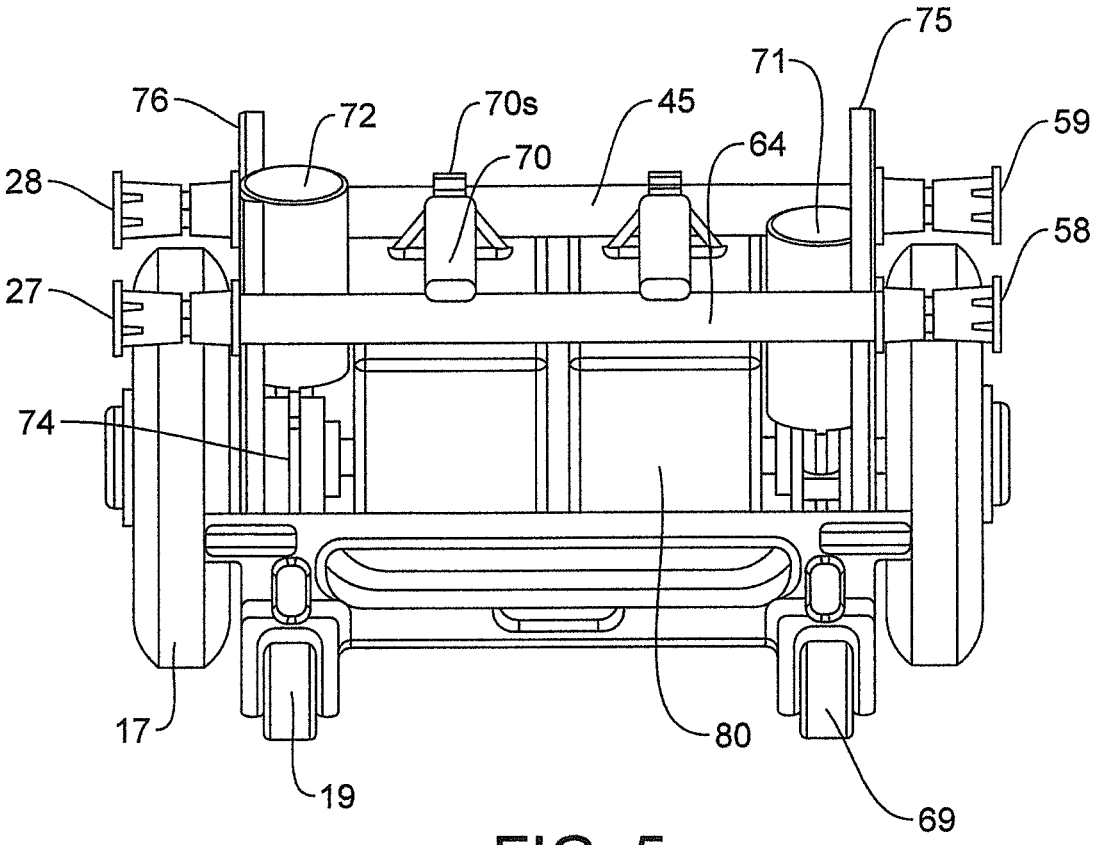
In FIG. 5, a cut-away view of the drive train and battery assembly is shown without the battery compartment cover for clarity.
Figure 5A:
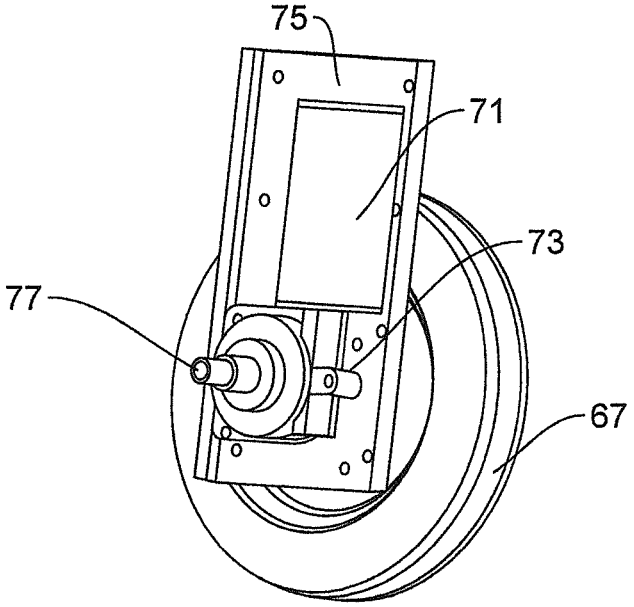
In FIG. 5*a*, the left side drive train is shown in detail (note: the right side is a mirror image of the left side).

The apparatus is designed with independent direct drive motors. FIGS. 5 and 5*a* detail the battery compartment and the independent direct drive assemblies. Batteries are located over the drive wheels to facilitate best traction and gives a more forward center of gravity to maintain stability as with the user onboard the center of gravity should be closest to the horizontal midpoint of the apparatus. In FIG. 5, battery compartment cover 31 is removed for clarity. An electric power storage device, in this case a battery 80 is held in place by battery clamp 70 which is attached at the distal end to stiffening rod 64 and threaded screw 70*s* is located on the proximal end of clamp 70 to secure the battery in place. In this apparatus two separate batteries are used, but this is not a limiting factor as any battery or batteries can be used that will accomplish the goals of this invention. Independent drive motors 71/72 directly drive the front tires 67/17 respectively. FIG. 5*a* shows the left side drive motor assembly mounted on motor plate 75 containing motor 71 with drive screw gear 73 driving axle 77. Direct drive is a preferred drive method as it provides a smoother and more responsive driving feel. This is not a limiting factor as other drive methods can be used, but direct drive is preferred to belt or chain drive. The drive components shown in FIG. 5*a* are replicated on the right side not shown in this figure using motor plate 76 containing motor 72 and drive screw gear 74.

Located immediately aft of said motor compartment is foot platform 11, which can be retracted to allow for a user to simply rotate up the seat portion and use the apparatus as a powered walker. The act of retracting said platform is performed by sliding the platform along platform rails 34, whereby the platform 11 slides under the battery compartment 30.

Figure 6:
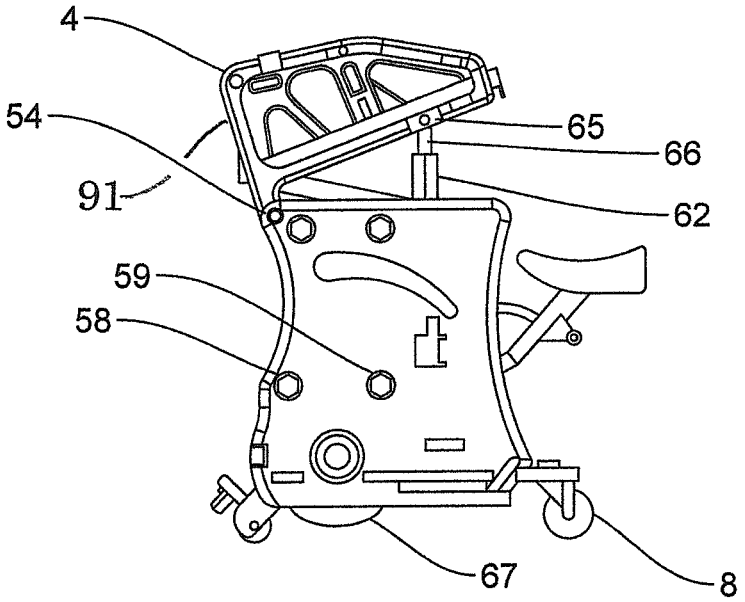
In FIG. 6, a left side elevation is shown with the front wheels in the downward or extended position.
Figure 7:
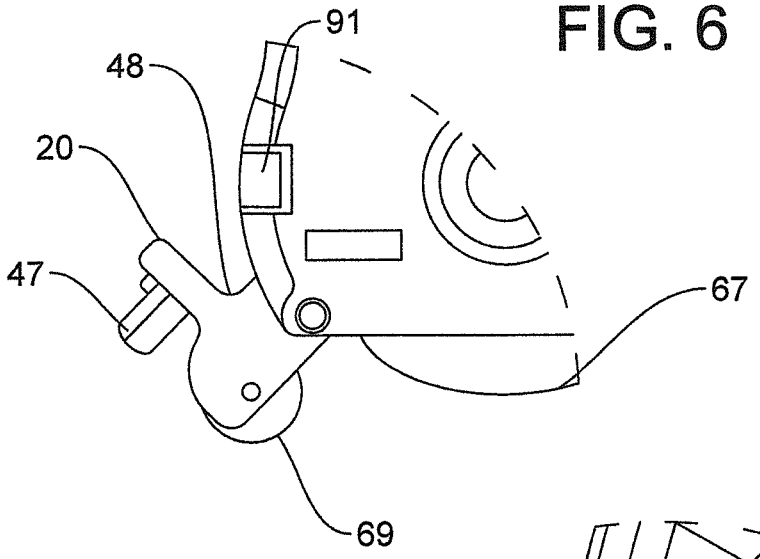
In FIG. 7, a close-up detail view of the front wheel in the extended position on the left side of the apparatus.
Figure 8:
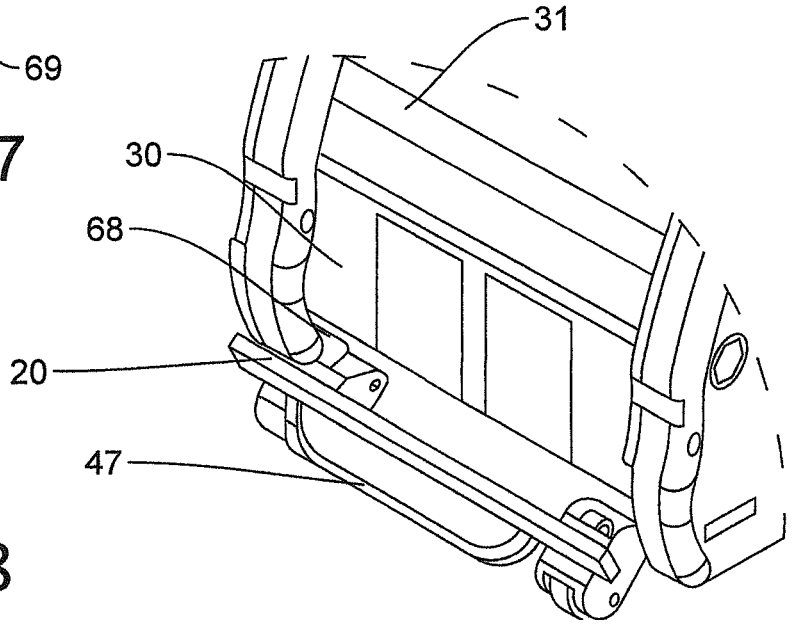
In FIG. 8, a frontal oblique view is shown where the front wheels are in the extended or down position.

Located on the front of the apparatus is the bumper 20 and front wheels 19 and 69 along with foot step 47 as part affront wheel assembly 48. FIGS. 6,7 and 8 detail the down position of the front wheel assembly 48. The operator or another will step down on the foot step 47 rotating the assembly 48 downwardly about hinge 68 until it locks into position. This invention is not limited to solely foot power to lower the assembly 48 and does not preclude electric or mechanical assistance to lowering the assembly. It is critical that the front wheels 19/69 have a smaller diameter than the larger drive tires 17 and that the center line of the front wheels 19/69 extend below the center line of the drive tires 17. This allows for the apparatus to maneuver through uneven ground, especially hills and valleys, such as speed bumps, gutters and drainage channels, such as the ones that are found in parking lots. Without such smaller wheels that raise the larger drive wheels and the undercarriage of the apparatus, the undercarriage would scrape and possibly hang up over the impediment due to the distance between the front drive wheels and the rear caster wheels. When the wheels are in the down tilted position, the apparatus can use the bumper to extend the tilting moment of the apparatus in cases of quick deceleration and in impact with immovable objects. This acts as an impact isolator as the energy of the collision with the ground or immovable object is absorbed by the soft plastic bumper which decreases the energy of the tilting moment.

Foot step 47 and bumper 20 serve additionally an added function of moving impediments, such as boxes, away from the front of the apparatus and also serve a purpose as guides to know where the front of the apparatus is located. Covered in non-marring plastic material, such as high density polyethylene, bumper 20 and foot step 47 are designed to protect the apparatus and objects that it runs into. The assembly 48 is rotatably connected to a lower portion of the front 50 of the apparatus 100 whereby the rotation of the assembly will achieve its goal of raising the front tire 17 off of the traveling surface. Additionally located on the forward edge of panels 3 and 4, are door guides 91 which center the apparatus in a tight doorframe and prevent marring of the door frame surface as the guides are made of a soft silicone like material.

Figure 3:
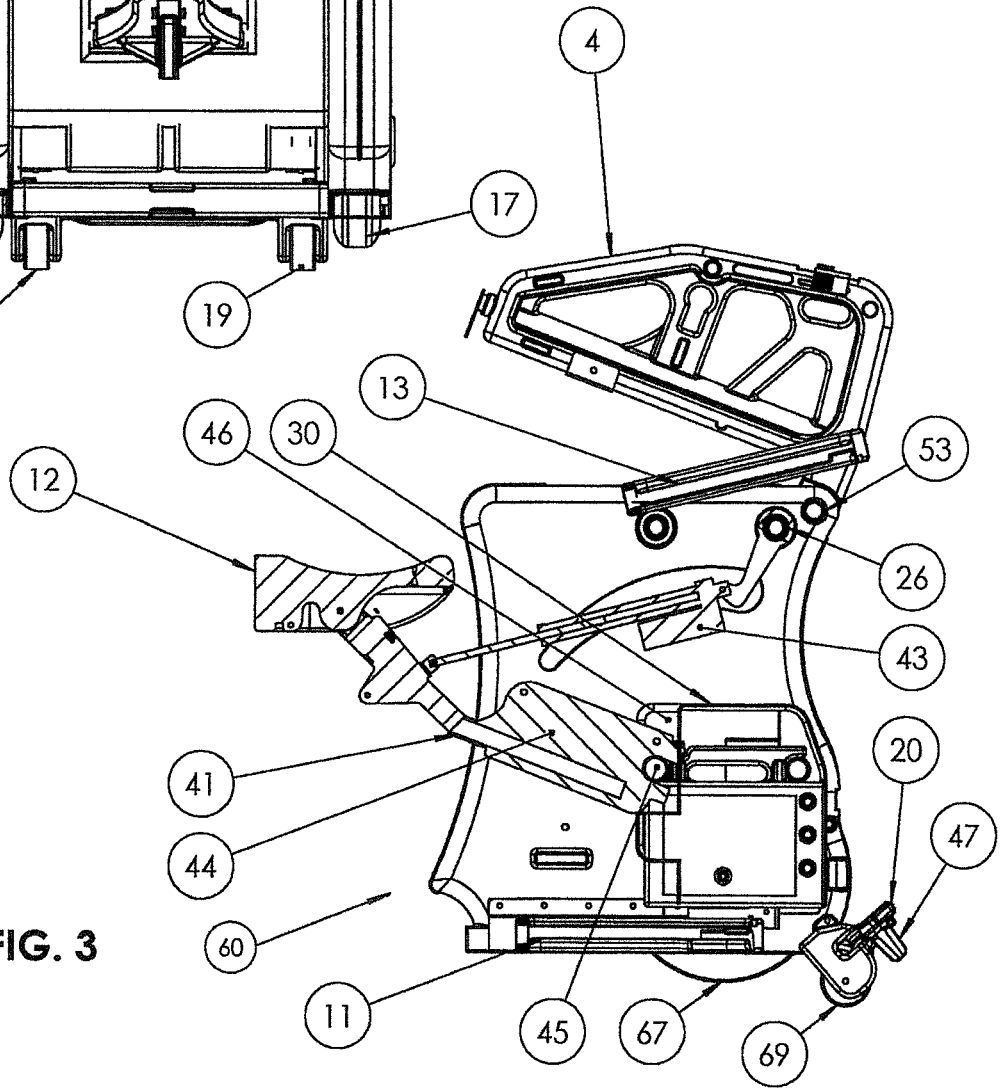
In FIG. 3, a vertical cross section of the apparatus is shown from the right side where the seat is in the down position.

Seat 12 is shown in a saddle style seat, but this does not limit the seat to a particular style, but is chosen for the broad support that is given by this style of seat. The seat assembly 51 consists of seat 12, seat adjustment component 41 which is directly attached to seat stiffening member 44. The seat is rotatably attached to seat attachment rod 45, rod 45 passing through battery compartment cover structure 30. The seat is allowed to being placed into a upper or closed position as closing connecting rod 43 is pushed forward causing seat rotational pivot point 26 to rotate about stiffening member 21. This is seen in detail through cutaway FIG. 3 and FIG. 9 which is a frontal oblique view of the apparatus. Connecting rod 43 can also be used in conjunction with a hydraulic cylinder (not shown) to aid in the closing or opening of the seat assembly and to act as a shock absorber during transit of the user.

Figure 20:
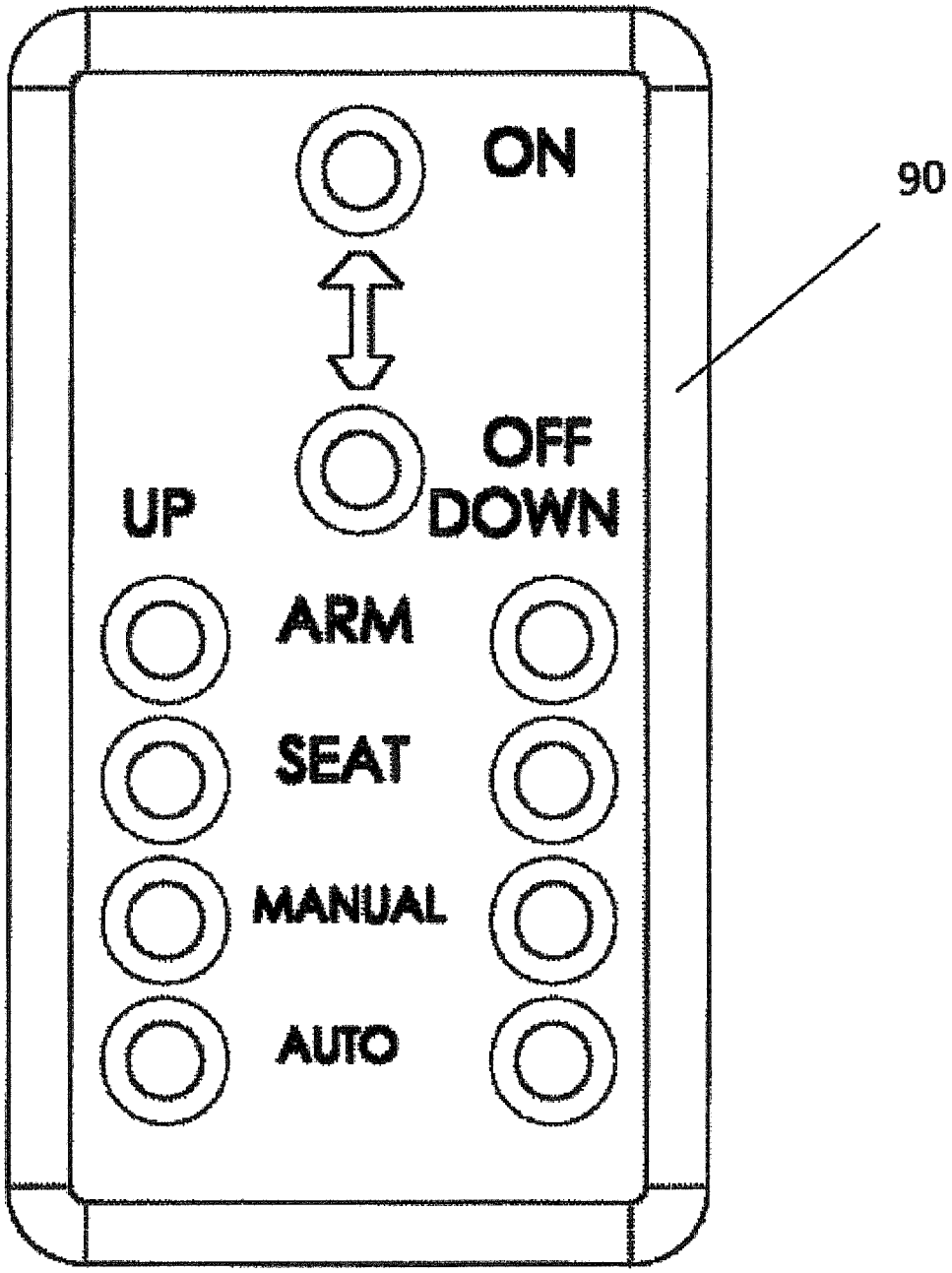
In FIG. 20, the keypad that is located on the remote fob is detailed. A similar keypad can also be located on the apparatus.

The user can use the controls located on the apparatus itself to raise and lower the arms, but can also use a remote fob 90 as shown in FIG. 20 to control the apparatus. Another advantage of the fob 90 is that the user can move the apparatus without being on the apparatus allowing for the user to put the apparatus away from their sleeping or sitting areas and be able to call it back.

It can be appreciated by those appropriately skilled in the art that changes, modifications or embodiments can be made to this invention without departing from the spirit, principles, theories, ideas or conceptions that have been disclosed in the foregoing. It is herein recognized that the embodiments disclosed by this description of the best mode of practicing this invention, which will be hereafter described in their full breadth in the claims and equivalents thereof.

The invention claimed is:

1. An improved powered pedestrian apparatus for ambulatory and non-ambulatory persons with increased load carrying attributes and rider comfort while transiting from location to location including vertical displacement capabilities comprising;

two vertical panels separated by stiffening members with conical ends terminating at said vertical panels, said panels having an exterior and interior side and front distal portion and a proximal rear portion; and two rotatably connected articulating arms, capable of rotating about a center point, at the proximal end of said arms, through an arc described by the length of said arms, where said center point is located on said front distal portion of each said vertical panels, said arms containing slidably attached extension members located at the distal ends of said arms, said arms containing speed and direction controls; and a vertical lift device located within said panels and attached to said arms, capable of rotating said arms about said center point; and a slidably attached standing foot platform extending between and connected thereto the lowest portions of said vertical panels; and at least two independent electric motors, directly attached to respective drive tires and electrically connected to an electric power storage device; and at least two rear caster wheels, slidably attached to respective ones of the panels, said caster wheels being capable of outward adjustment thereby increasing the wheelbase of said apparatus; and at least two front tires, said front tires being of smaller diameter than said drive tires, said front tires being assembled and vertically gimbled about a front portion of said apparatus; and a seat capable of movement vertically, rotatably connected to said stiffening members.

2. An improved powered pedestrian apparatus for ambulatory and non-ambulatory persons as in claim 1 where said speed controls contain a maximum velocity restrictor limiting the speed of said apparatus.

3. An improved powered pedestrian apparatus for ambulatory and non-ambulatory persons as in claim 2, where said velocity restrictor is adjustable either through electrical contact or manually adjustable limiting stops.

4. An improved powered pedestrian apparatus for ambulatory and non-ambulatory persons as in claim 2 where said speed controls require positive contact by the user to maintain speed and absence of positive contact immediately stops said apparatus.

5. An improved powered pedestrian apparatus for ambulatory and non-ambulatory persons as in claim 2 where said speed controls includes a momentary contact reversing switch, whose constant contact thereon is required to reverse the travel direction of said apparatus.

6. An improved powered pedestrian apparatus for ambulatory and non-ambulatory persons as in claim 1 where said articulating arms are adapted to receive a perpendicular removable support member.

7. An improved powered pedestrian apparatus for ambulatory and non-ambulatory persons as in claim 1 where said rear caster wheels are of smaller diameter than said drive wheels.

8. An improved powered pedestrian apparatus for ambulatory and non-ambulatory persons as in claim 7 where said rear caster wheels are slidably able to increase said wheel base thereby moving the center of gravity rearward to facilitate the entry of a user into the apparatus.

9. An improved powered pedestrian apparatus for ambulatory and non-ambulatory persons as in claim 8 where said arms have respective extending support armrests which are slidably related to the distal end of said arms.

10. An improved powered pedestrian apparatus for ambulatory and non-ambulatory persons as in claim 9 where a front tire assembly is capable of vertical rotation about the lower distal portion of said vertical panels, where said vertical rotation will cause said drive tires to lose their engagement with the transit surface.

11. An improved powered pedestrian apparatus for ambulatory and non-ambulatory persons as in claim 1 where said articulating arms are designed to raise a person from a sitting or prone position by the activation of a vertical actuated rod attached near the distal end of said arms.

12. An improved powered pedestrian apparatus for ambulatory and non-ambulatory persons as in claim 1 where a front tire assembly comprises said tires, a soft plastic bumper and a foot activation step.

13. An improved powered pedestrian apparatus for ambulatory and non-ambulatory persons as in claim 1 where said independent electric motors are capable of transiting in both a forward and reverse modes, said modes being demanded through input from said speed controls.

14. An improved powered pedestrian apparatus for ambulatory and non-ambulatory persons as in claim 1 where functions of said speed control, vertical activation of arms and direction control can be accomplished through controls located on said apparatus.

15. An improved powered pedestrian apparatus for ambulatory and non-ambulatory persons as in claim 1 where said speed control, vertical activation of arms and direction control can be accomplished through a remote control fob to remotely control the functions of said apparatus.

16. An improved powered pedestrian apparatus for ambulatory and non-ambulatory persons as in claim 1 where seat can be raised vertical and rotated inwardly to allow for a user to stand on said foot platform.

17. An improved powered pedestrian apparatus for ambulatory and non-ambulatory persons as in claim 1 where seat can be raised vertical and rotated inwardly to allow for a user to walk as the apparatus transits, where said rotatably connected arms provide support for the user.

18. An improved powered pedestrian apparatus for ambulatory and non-ambulatory persons as in claim 1 where a working surface is positioned between said vertical panels, said working surface being removably rotatably connected to a stiffening member.

19. An improved powered pedestrian apparatus for ambulatory and non-ambulatory persons as in claim 1 where said rotatably connected arms are adapted to facilitate the mounting of safety equipment.

20. An improved powered pedestrian apparatus for ambulatory and non-ambulatory persons with increased load carrying attributes and rider comfort while transiting from location to location including vertical displacement capabilities comprising;

two vertical panels separated by stiffening members with conical ends terminating at said vertical panels, said panels having an exterior and interior side and front distal portion and a proximal rear portion; and two rotatably connected articulating arms, capable of rotating about a center point, at the proximal end of said arms, through an arc described by the length of said arms, where said center point is located on said front distal portion of each said vertical panels, said arms containing slidably attached extension members located at the distal ends of said arms; and a vertical lift device located within said panels and attached to said arms, capable of rotating said arms about said center point; and a slidably attached standing foot platform extending between and connected thereto the lowest portions of said vertical panels; and at least two independent electric motors, directly attached to respective drive tires and electrically connected to an electric power storage device; and at least two rear caster wheels, slidably attached to respective ones of the panels, said caster wheels being capable of outward adjustment thereby increasing the wheelbase of said apparatus; and at least two front tires, said front tires being of smaller diameter than said drive tires, said front tires being assembled and vertically gimbled about said front portion of said apparatus; and a working surface removably attached to said stiffening members and located between said vertical panels; and a set of controls for speed, vertical arm displacement and transit direction; and a seat capable of movement vertically.

* * * * *